US007473450B2

(12) United States Patent
Hirota

(10) Patent No.: US 7,473,450 B2
(45) Date of Patent: Jan. 6, 2009

(54) PROTECTIVE LAYER THERMAL TRANSFER FILM AND PRINTED ARTICLE

(75) Inventor: Kenichi Hirota, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 11/662,900

(22) PCT Filed: Sep. 27, 2005

(86) PCT No.: PCT/JP2005/017753

§ 371 (c)(1),
(2), (4) Date: Mar. 15, 2007

(87) PCT Pub. No.: WO2006/035774

PCT Pub. Date: Apr. 6, 2006

(65) Prior Publication Data

US 2007/0292639 A1 Dec. 20, 2007

(30) Foreign Application Priority Data

Sep. 29, 2004 (JP) ..... 2004-284262

(51) Int. Cl.
*B41M 5/42* (2006.01)

(52) U.S. Cl. ..... 428/32.77; 156/239; 156/240; 428/32.81; 503/227

(58) Field of Classification Search ..... None
See application file for complete search history.

(56) References Cited

U.S. PATENT DOCUMENTS 5,147,843 A 9/1992 Bodem et al.

FOREIGN PATENT DOCUMENTS

| | | | |
|---|---|---|---|
| EP | 0 513 800 | A1 | 11/1992 |
| EP | 1 518 709 | A1 | 3/2005 |
| JP | 03-082595 | A | 4/1991 |
| JP | 05-131760 | A | 5/1993 |
| JP | 07-061172 | A | 3/1995 |
| JP | 09-099656 | A | 4/1997 |
| JP | 2000-071626 | A | 3/2000 |
| JP | 2000-080844 | A | 3/2000 |
| JP | 2001-199162 | A | 7/2001 |
| JP | 2002-079766 | A | 3/2002 |
| JP | 2002-274064 | A | 9/2002 |
| JP | 2005-096200 | A | 4/2005 |

*Primary Examiner*—Bruce H Hess
(74) *Attorney, Agent, or Firm*—Birch, Stewart, Kolasch & Birch LLP.

(57) ABSTRACT

To provide a protective layer thermal transfer film which can form a protective layer that is superior in the water based ink fixing property, solvent-resistant property and, in particular, water-resistant property and also has a superior peeling property.

The present invention relates to:

a protective layer thermal transfer film, comprising:

a thermally transferable protective layer on or over at least one part of one surface of a substrate film, wherein the protective layer is formed on or over the substrate by laminating at least a peeling layer serving as an outermost surface layer after transfer; and the peeling layer containing at least polyvinyl pyrrolidone, and a printed article with the protective layer transferred onto an image on the printed article.

8 Claims, 1 Drawing Sheet

PROTECTIVE LAYER THERMAL TRANSFER FILM AND PRINTED ARTICLE

TECHNICAL FILED

The present invention relates to a protective layer thermal transfer film and a printed article having an image on which the protective layer of the film is transferred.

BACKGROUND ART

Conventionally, images such as tone images and monotone images including characters and symbols have been formed on a substrate through a thermal transfer system. With respect to the thermal transfer system, a heat-sensitive sublimation transfer system and a heat-sensitive melt transfer system have been widely used.

Of these systems, in the heat-sensitive sublimation transfer system, a thermal transfer film formed by supporting a dye layer made by melting or dispersing a sublimable dye serving as a colorant in a binder resin on a substrate is used, and with this thermal transfer film being superposed on an image-receiving film, energy is applied to a heating device such as a thermal head in accordance with image information so that the sublimable dye contained in the dye layer on the thermal transfer film is transferred to the image-receiving film to form an image thereon.

This heat-sensitive sublimation transfer system makes it possible to control the amount of dye transfer on a dot basis in response to the quantity of energy to be applied to the thermal transfer film; therefore, this system has the advantages of forming a superior tone image and of easily forming characters, symbols and the like.

In the image formed by the heat-sensitive sublimation transfer system, since the transferred dye is present on the surface of the image-receiving member, various techniques have been proposed to protect the image and to form a protective layer on the image from the viewpoints of image protection such as light resistance and abrasion resistance (for example, see Patent Document 1 and Patent Document 2).

However, among the printed articles sublimation-transferred, some of the printed articles call for a proper stamping property for use in water based type stamps (for example, printed articles used for certificate photographs such as passports). In other words, a proper fixing property for water based ink is required.

From the viewpoint of fixing property for water based ink, for example, in the field of ink-jet receiving layers, an ink-jet receiving layer in which the outermost surface layer is made of a water-absorbing resin such as polyvinyl alcohol (PVA) containing a large amount of particles such as silica has been known. However, the ink-jet receiving layer of this type is applied with a considerable amount of coating material (normally, 10 g/m$^2$ or more) so as to maintain a sufficient water based ink fixing property. Consequently, even in an attempt to utilize such a receiving layer as a protective layer for a printed article formed through the thermal transfer system, problems arise in which: the foil-separating property is poor and the transparency of the film becomes insufficient. With respect to the protective layer for a printed image formed through the thermal transfer system, a proper fixing property for water based stamp is required in addition to the thin-film and transparent properties; therefore, the techniques for the ink-jet receiving layer are hardly applied to the protective layer for a protective layer thermal transfer film.

Moreover, with respect to the protective layer of a printed article formed through the thermal transfer system such as a sublimation transfer system, a property that is contradictory to the water based ink fixing property, that is, a water-resistant property (by which no problem is raised even when wiped after having been moistened with water), is also required.

Furthermore, since the protective layer thermal transfer film is prepared with a water-absorbing resin layer serving as a peeling interface, the film or sheet has a change in adhesion on the peeling interface before and after preservation under high-temperature and high-humidity environment, resulting in the problem of an insufficient peeling property.

Patent Document 1: Japanese Patent Application Laid-Open No. 2000-80844

Patent Document 2: Japanese Patent Application Laid-Open No. 2000-71626

DISCLOSURE OF INVENTION

Problems to be Solved by the Invention

The present invention has been made to solve the above-mentioned problems, and its objective is to provide a protective layer thermal transfer film which can form a protective layer that is superior in the water based ink fixing property, solvent-resistant property and, in particular, water-resistant property and also has a superior peeling property.

Means to Solve the Problems

In other words, the present invention relates to a protective layer thermal transfer film, comprising:

- a thermally transferable protective layer on or over at least one part of one surface of a substrate film,
- wherein the protective layer is formed on or over the substrate by laminating at least a peeling layer serving as an outermost surface layer after transfer; and
- the peeling layer containing at least polyvinyl alcohol, polyvinyl pyrrolidone and an inorganic filler. The present invention also relates to a printed article having such a protective layer.

EFFECT OF THE INVENTION

The protective layer thermal transfer film of the present invention makes it possible to form a protective layer that is superior in the water based ink fixing property, solvent-resistant property and, in particular, water-resistant property, and also has a superior peeling property.

A image-receiving member on which the protective layer of the protective layer thermal transfer film of the present invention has been transferred is superior in the stamping property for water based type materials as well as in the writing property for water based ink or the like.

EXPLANATION OF REFERENCES

Figure 1:
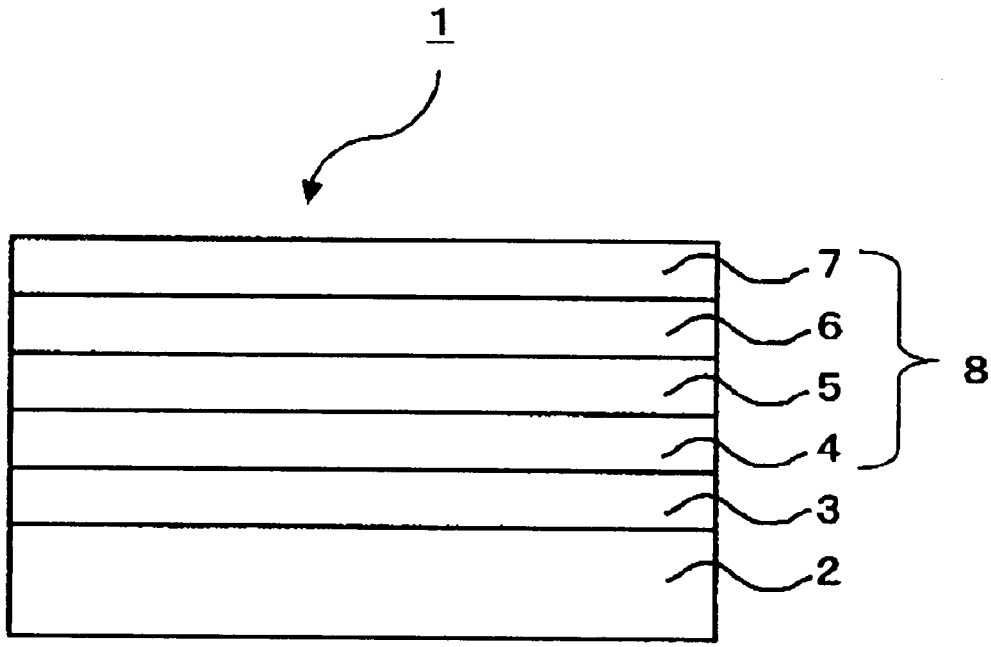
FIG. 1 is a schematic cross-sectional view that shows one embodiment of a protective layer thermal transfer film of the present invention.

1 Protective layer thermal transfer film
2 Substrate film
3 Release layer

4 Peeling layer
5 Porous layer
6 Primer layer
7 Heat seal layer (HS layer)
8 Protective layer
21 Protective layer thermal transfer film
22 Substrate film
26 Thermal transfer protective layer
27 Back layer

BEST MODE FOR CARRYING OUT THE INVENTION

FIG. 1 is a schematic cross-sectional view that shows one example of a protective layer thermal transfer film of the present invention. In this Figure, the protective layer thermal transfer film 1 is constituted by a release layer 3, a peeling layer 4, a porous layer 5, a primer layer 6 and a heat seal layer (HS layer) 7 that are successively formed on one surface of a substrate film 2. Among these, a layered product from which the substrate film 2 and the release layer 3 are excluded is referred to as a protective layer 8.

With respect to the substrate film 1, not particularly limited, the same substrate film as those widely used in this field may be used. Specific examples of the substrate film include: polyesters having high heat resistance, such as polyethylene terephthalate, polyethylene naphthalate, polybutylene terephthalate, polyphenylene sulfide, polyether ketone and polyether sulfone; and plastic films, such as polypropylene, polycarbonate, cellulose acetate, derivatives of polyethylene, polyvinyl chloride, polyvinylidene chloride, polystyrene, polyamide, polyimide, polymethyl pentene and ionomer, and a layered product thereof and the like. The above-mentioned plastic film may be used as a drawn film, or may be used as an undrawn film. The thickness of the substrate film is properly selected by taking strength, heat resistance and the like into consideration, and is normally set in a range of from 1 to 100 μm.

In the case where the peeling property between the substrate film and the protective layer is not appropriate, the release layer 3 is formed, if necessary, so as to adjust the adhesion between the substrate film and the protective layer and consequently to desirably carry out a peeling process of the protective layer.

The release layer 3 is formed from, for example, various waxes or silicone oil, such as silicone wax, or various resins such as silicone resin, fluororesin, acrylic resin (which is used as a definition including both of acrylic resin and methacrylic resin), water soluble resin, cellulose derivative resin, urethane-based resin, acetic acid-based resin, acrylic vinyl ether-based resin and maleic anhydride resin, or mixtures thereof. In the present invention, acrylic resin, in particular, a thermo-curing silicone-modified acrylic resin, is preferably used, and this is preferably used in combination with silicone oil. When a curable resin is used, a curing agent such as an aluminum chelate compound is added to the curable resin in a range from 1 to 10% by weight with respect to the curable resin.

The release layer 3 is formed through processes in which a coating solution, prepared by dissolving or decomposing the above-mentioned resin, wax and other desired additives in a solvent such as an organic solvent, is applied to the substrate film by using a conventionally known coating method such as a wire coating method, and cured thereon, if necessary, and then dried. The thickness of the release layer is normally set in a range from 0.1 to 5 μm, preferably from 0.5 to 5.0 μm, more preferably from 0.5 to 2 μm.

Upon forming the release layer 3, the formation is carried out so that the protective layer is separated from the peeling layer 4 upon transferring, while the release layer 3 is allowed to remain on the side of the substrate film 2.

The peeling layer 4 is formed from at least polyvinyl alcohol, polyvinyl pyrrolidone and an inorganic filler.

With respect to polyvinyl alcohol, it is set to have a number-average molecular weight (Mn) of 50000 to 120000, preferably 60000 to 100000, and a degree of saponification of 80% or more. With respect to the degree of saponification, the higher the value, the better. The molecular weight of polyvinyl alcohol is given as a value found by a commonly-used method in which calculations are made based upon measurements on the specific viscosity by the use of a capillary viscometer. Polyvinyl alcohol is a component that shoulders the water resistant property (solvent resistant property). The degree of saponification refers to a rate of an actual saponification value to the theoretical value of saponification value in the case of complete saponification, and is found through a commonly-used method in which the amount of alkali required for saponification is found through titration and this is used for the corresponding calculations.

With respect to polyvinyl pyrrolidone, it is preferably set to have a number-average molecular weight (Mn) of 350000 to 3500000, preferably 1000000 to 2000000, and a K-value of 60 to 120. Polyvinyl pyrrolidone is a component used for shouldering the stamping property.

In the present invention, the molecular weight of polyvinyl pyrrolidone is indicated by a value measured by the GPC method. The K-value refers to a scale of the molecular weight that is closely correlated with the viscosity derived from a relational expression, $(\log \eta/c)=(75K^2/(1+1.5\ Kc))+K$, where the specific viscosity is indicated by $\eta$ and the solution concentration is indicated by c(g/dL). The specific viscosity $\eta$ is given as a value measured through a commonly-used method in which a capillary viscometer is used.

With respect to polyvinyl alcohol (PVA) and polyvinyl pyrrolidone (PVP), these materials are used at a rate of PVA/PVP (weight ratio) in a range from 5/1 to 1/5, preferably from 1/2 to 2/1. When excessive polyvinyl alcohol is used, the stamping property is lowered; in contrast, when excessive polyvinyl pyrrolidone is used, the water resistant property (solvent resistant property) is lowered.

The total amount of use of polyvinyl alcohol and polyvinyl pyrrolidone is set from 20 to 80% by weight, preferably from 40 to 60% by weight, with respect to the total weight of the peeling layer.

With respect to the inorganic filler, for example, silica, titania, alumina, nylon filler, organic filler, or the like is used, and preferably silica is used. The inorganic filler to be used has an alkaline property and an average particle size of 100 nm or less. With respect to the particle size, the smaller, the better. When the particle size of the inorganic filler is too large, a problem arises in which a large amount of addition thereof impairs the transparency of a film. When the inorganic filler fails to have an alkaline property, a problem arises in which, when it is mixed with polyvinyl pyrrolidone upon forming a film, the resulting solution is gelatinized.

The amount of use of the inorganic filler is set from 20 to 80% by weight, preferably from 40 to 60% by weight, with respect to the total weight of the peeling layer. When the amount of use is too small, the stamping property and the water resistant property (solvent resistant property) deteriorate. When the amount of use is too large, the transparency of the film deteriorates.

In addition, coating-property improving agents, such as a leveling agent and an antifoamer, and additives, such as a fluorescent whitener and a ultraviolet-ray absorbing agent, may be added to the peeling layer in a range from 0.01 to 5% by weight with respect to the total weight of the peeling layer.

The peeling layer is formed through processes in which: a coating solution, prepared by dissolving or decomposing polyvinyl alcohol, polyvinyl pyrrolidone, an inorganic filler and other additives in a solvent such as water and an organic solvent, is applied to a substrate film or a release layer formed on the substrate film by using a conventionally known coating method such as a wire coating method, and dried thereon. The thickness of the peeling layer is normally set in a range from 0.01 to 2 μm, preferably from 0.1 to 0.5 μm.

The porous layer 5 is formed from at least polyvinyl alcohol, an inorganic filler and a curing agent. With respect to polyvinyl alcohol and inorganic filler, the same materials as those used for the peeling layer may be adopted.

Polyvinyl alcohol is a component that shoulders the water resistant property and solvent resistant property. The amount of use of polyvinyl alcohol is set in a range from 5 to 50% by weight, preferably from 10 to 40% by weight, with respect to the total weight of the porous layer. When the amount is too small, a problem arises in which the coat film deteriorates in its solvent resistant property; in contrast, when the amount is too large, a problem of tailing arises upon printing.

The amount of use of the inorganic filler is set in a range from 50 to 95% by weight, preferably from 60 to 95% by weight, with respect to the total weight of the porous layer. When the amount is too large, a problem arises in which the coat film deteriorates in its solvent resistant property; in contrast, when the amount is too small, a problem arises in which the foil-separating property deteriorates.

The curing agent to be added to the porous layer is used for applying a water resistant property and a solvent resistant property to polyvinyl alcohol, and for example, an isocyanate compound, a melamine compound and a chelating agent are used, and a melamine compound is preferably used. The amount of use of the curing agent is set in a range from 0.01 to 1% by weight, preferably from 0.05 to 5% by weight, with respect to polyvinyl alcohol. When the amount of use of the curing agent is too large, the foil-separating property deteriorates. When the amount of use of the curing agent is too small, the water resistant property and the solvent resistant property deteriorate.

In addition, coating-property improving agents, such as a leveling agent and an antifoamer, and additives, such as a fluorescent whitener and a ultraviolet-ray absorbing agent, may be added to the porous layer in a range from 0.01 to 5% by weight with respect to the total weight of the porous layer.

The porous layer is formed through processes in which: a coating solution, prepared by dissolving or decomposing polyvinyl alcohol, inorganic filler, a curing agent and other additives in a solvent such as water and an organic solvent, is applied to the peeling layer by using a conventionally known coating method such as a wire coating method, and cured and dried thereon. The thickness of the porous layer is normally set in a range from 0.1 to 2 μm, preferably from 0.3 to 1 μm.

The primer layer 6 is mainly formed from a polymaleic anhydride resin and an acrylic resin, and is preferably formed from methyl polymethacrylate resin. The primer layer 6 has a function for ensuring adhesion between the porous layer 6 and a heat seal layer to be further formed thereon, and therefore, is required to exert a high compatibility with a heat seal layer (solvent-based resin) which will be described below, needs to be soluble to an alcohol-based solvent and a ketone-based solvent, and also needs to have a water resistant property to a certain degree. The primer layer is formed from these viewpoints.

With respect to the polymaleic anhydride resin, those having a number-average molecular weight (Mn) of 50000 to 500000, preferably 100000 to 300000, are used. In the present invention, the molecular weight of polymaleic anhydride is indicated by a value measured by the GPC method.

With respect to the acrylic resin, those resins having a weight-average molecular weight (Mw) of 10000 to 100000, preferably 20000 to 50000, are used. In the present invention, the molecular weight of acrylic resin is indicated by a value measured by the GPC method.

With respect to polymaleic anhydride resin and acrylic resin, these materials are used at a rate in a range from 5/1 to 1/5, preferably from 1/2 to 2/1. When an excessive amount of polymaleic anhydride resin is used, problems arise in which the water resistant property deteriorates and the adhesion to the heat seal layer is lowered; in contrast, when an excessive amount of acrylic resin is used, problems arise in which the solvent resistant property deteriorates and the adhesion to the porous layer is lowered.

The total amount of use of the polymaleic anhydride resin and the acrylic resin is set to 50% by weight or more, preferably to 90% by weight or more, with respect to the total weight of the primer layer.

It is preferable that urethane polyol is added to the primer layer. This urethane polyol is used for improving the adhesion to the heat seal layer.

Upon addition, the amount of urethane polyol is set in a range from 1 to 15% by weight, preferably from 5 to 10% by weight, with respect to the total amount of the primer layer. When the amount of use is too large, the transparency of the film deteriorates; in contrast, when the amount of use is too small, the effect of improving the adhesion is not exerted sufficiently.

In addition, coating-property improving agents, such as a leveling agent and an antifoamer, and additives, such as a fluorescent whitener and a ultraviolet-ray absorbing agent, may be added to the primer layer in a range from 0.01 to 5% by weight with respect to the total weight of the primer layer.

The primer layer is formed through processes in which: a coating solution, prepared by dissolving or dispersing a polymaleic anhydride resin, an acrylic resin and urethane polyol, if necessary, and other additives in a solvent such as an organic solvent, is applied onto the porous layer by using a conventionally known coating method such as a wire coating method, and cured and dried thereon. The thickness of the primer layer is normally set in a range from 0.1 to 2 μm, preferably from 0.2 to 1 μm.

The heat seal layer shoulders the adhesion of a protective layer to an image surface. With respect to the resin forming the heat seal layer, any one of conventionally known resins in which a sticker, a heat-sensitive bonding agent and the like are blended may be used, and those thermoplastic resins having a glass transition temperature (Tg) in a range from 50 to 100° C., preferably from 70 to 100° C., are preferably used. Specific examples of these thermoplastic resins include: polyester resin, vinyl chloride-vinyl acetate copolymer resin, acrylic resin, butyral resin, epoxy resin, polyamide resin and vinyl chloride resin. Additives, such as an ultraviolet-ray absorbing agent, an antioxidant and a fluorescent whitener, may be added to the heat seal layer.

The heat seal layer is formed through processes in which: a coating solution, prepared by dissolving or decomposing the above-mentioned resin and other additives in a solvent such as an organic solvent, is applied onto the primer layer by using a conventionally known coating method such as a wire coating method, and cured and dried thereon. The thickness of the heat seal layer is normally set in a range from 0.1 to 10 μm, preferably from 0.5 to 5 μm.

In the present invention, a back layer may be formed on the other face of the substrate film. The back layer is placed so as to prevent heat seal between a heating device such as a thermal head and the substrate film 2 and provide a smooth traveling operation. Examples of the resin to be used for this back layer include cellulose-based resins, such as ethyl cellulose, hydroxy cellulose, hydroxypropyl cellulose, methyl cellulose, cellulose acetate, cellulose butyrate, nitrocellulose; polyvinyl-based resins, such as polyvinyl alcohol, polyvinyl acetate, polyvinyl butyral, polyvinyl acetal and polyvinyl pyrrolidone; acrylic resins, such as polymethyl methacrylate, polyethyl acrylate, polyacrylamide and acrylonitrile-styrene copolymer; polyamide resin; polyvinyl toluene resin; coumarone indene resin; polyester resin; polyurethane resin; and a single substance or a mixture of natural or synthetic resins, such as silicone modified or fluorine-modified urethane. In order to further improve the heat resistance of the back layer, it is preferable that, among the above-mentioned resins, a resin having a hydroxyl group-based reactive group (for example, butyral resin, acetal resin and the like) is used in combination with polyisocyanate or the like as a crosslinking agent to form a crosslinked resin layer.

In order to impart a sliding property with the thermal head, a solid-state or liquid-state release agent or lubricant may be added to the back layer so as to provide a heat-resistant lubricating property. Examples of the release agent or lubricant include various waxes such as polyethylene wax and paraffin wax; various surfactants, such as higher fatty alcohol, organopolysiloxane, anionic surfactants, cationic surfactants, amphoteric surfactants, nonionic surfactants and fluorine-based surfactants; organic carboxylic acids and derivatives thereof, fluorine-based resins, silicone-based resins, fine particles of inorganic compounds such as talc and silica. The amount of lubricant to be contained in the back layer is set in a range from 5 to 50% by weight, preferably from 10 to 30% by weight, in the back surface.

The back layer is formed through processes in which: a coating solution, prepared by dissolving or dispersing the resin and the other additives in a solvent such as water and an organic solvent, is applied to the substrate film by using a normal coating method such as a wire coating method, and the resulting layer is dried thereon. The thickness of the back layer is normally set in a range from 0.1 to 10 μm, more preferably from 0.5 to 5 μm.

The protective layer thermal transfer film of the present invention is not intended to be limited by the above-mentioned mode, and is desirably formed in accordance with the intended purpose and the like as a film, such as a composite protective layer thermal transfer film of a thermally transferring protective layer with a heat sublimable color material layer and a composite protective layer thermal transfer film of a thermally transferring protective layer with a heat meltable color material layer. In the case of the former composite protective layer thermal transfer film, as long as the image-receiving member has a receiving layer for dyes, an image-forming process through a thermal transfer system and a transferring process of the protective layer to the image-receiving member are simultaneously carried out.

With respect to another example of the protective-layer transferring film, for example, a protective layer thermal transfer film in which a thermal transfer protective layer and at least one color material layer selected from the group consisting of a heat sublimable color material layer and a heat meltable color material layer are formed on one surface of a substrate film in a face-sequential manner may be used.

Figure 2:
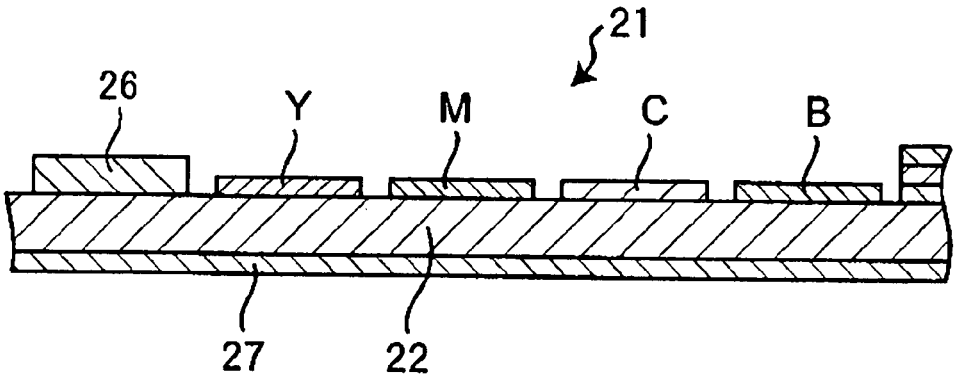
FIG. 2 is a schematic cross-sectional view that shows one embodiment of a protective layer thermal transfer sheet of the present invention.

FIG. 2 is a schematic cross-sectional view that shows another example of the protective layer thermal transfer film of the present invention. In FIG. 2, the protective layer thermal transfer film 21 of the present invention is constituted by a heat sublimable color material layer Y, a heat sublimable color material layer M, a heat sublimable color material layer C, a heat sublimable color material layer B and a thermal transfer protective layer 26 that are formed on one surface of a substrate film 22 in a face-sequential manner, and a back layer 27 is formed on the other face of the substrate film 22. The heat sublimable color material layers Y, M, C and B, shown in FIG. 2, may be replaced by heat meltable color material layers Y, M, C and B, or a mixed structure of these layers may be used.

Examples of the image-receiving member may include films formed by any substrate sheet, such as plain paper, wood free paper, tracing paper and a plastic film. The image-receiving member may have any one of shapes including a card, a post card, a passport, letter paper, report paper, a notebook and a catalogue.

Specific examples of the image-receiving member of the present invention include: share certificates, bonds, certificates, passbooks, train tickets, bicycle or horse race tickets, and premium tickets, such as stamps, postal stamps, theater tickets, entrance tickets and other tickets; various cards, such as cash cards, credit cards, prepaid cards, members cards, greeting cards, post cards, name cards, driver's licenses, IC cards and optical cards; cases such as cartons and containers; bags; forms, envelopes, tags, OHP sheets, slide films, bookmarks, calendars, posters, pamphlets, menus, passports, POP articles, coasters, displays, name plates, keyboards, cosmetics, ornaments, such as wristwatches and lighters; stationary such as writing materials and report paper; building materials, panels, emblems, keys, cloths, clothing, footwear, apparatuses such as radios, televisions, electronic calculators and OA devices, various sample catalogues, albums, outputs from computer graphics, medical image outputs, and the like.

The image on the image-receiving member may be formed through any one of the systems, such as an electrophotographic system, an ink-jet recording system and a thermal transfer recording system.

Since the image-receiving member on which the protective layer thermal transfer film has been transferred exerts a good fixing property for water based ink, it becomes possible to provide superior stamping property for water based type materials and writing property for water based ink or the like.

Upon application of the protective layer thermal transfer film of the present invention, a conventionally-known method of use for the protective layer thermal transfer film may be adopted as it is. For example, the layer face of the heat seal layer of the protective layer thermal transfer film of the present invention is superposed on the image-receiving member so that the protective layer may be thermally transferred onto the image-receiving member.

EXAMPLES

Examples of the present invention will be explained below. Articles used in the present Examples are briefly listed below. Here, "%" refers to "% by weight", unless otherwise indicated.

Celltop 226: Silicone-modified acrylic resin, made by Daicel Chemical Industries, Ltd., solid component: 50%

Celltop CAT-A: Curing agent made by Daicel Chemical Industries, Ltd., solid component: 10%

KF-355A: Silicone oil, made by Shin-Etsu Chemical Co., Ltd., Viscosity 150 $mm^2/s$ (25° C.)

RS-1717: Polyvinyl alcohol, made by Kuraray, Co., Ltd., Degree of saponification 95% , Mn: 80000

PVP-K90: Polyvinyl pyrrolidone, made by ISP Japan Ltd., Mn: 1570000 (K-value=90)

Snowtex 20L: Colloidal silica, made by Nissan Chemical Industries, Ltd., Average particle size: 40 nm C318: Polyvinyl alcohol, made by Kuraray, Co., Ltd., Degree of saponification 80%, Mn: 80000

Snowtex OL-40: Colloidal silica, made by Nissan Chemical Industries, Ltd., Average particle size: 40 nm Vylonal MD-1500: Polyester, made by Toyobo Co., Ltd.

Sumirez Resin 5004: Curing agent made by Sumitomo Chemical Co., Ltd.,

Gantrez AN-119: Polymaleic anhydride, made by ISP Japan Ltd., Mn: 130000

Dianal BR-87: Polymethyl methacrylate (PMMA) made by Mitsubishi Rayon Co., Ltd., Mw: 25000

Sanprene IB-114: Urethane polyol, made by Sanyo Chemical Industries, Ltd., Dianal LR-209: Acrylic polyol, made by Mitsubishi Rayon Co., Ltd.

Byron 700: Polyester, made by Toyobo Co., Ltd., Mn: 9000

PUVA-50M-40TM: (UVA) -containing acrylic resin, made by Otsuka Chemical Co., Ltd., Mn: 30000

Tinuvin 900: UVA compound, made by Ciba Specialty Chemicals.

Sylysia 310P: Silica filer, made by Fuji Silysia Chemical Ltd., Average particle size 3 μm UVA is the abbreviation of "ULTRA-VIOLET LIGHT ABSORBER".

Formation of protective layer thermal transfer film (ribbon)

Examples 1 to 3, Comparative Examples 1 to 9

First Layer (Release Layer)

The corresponding mixed matter shown in Tables 1 and 2 ("%" in Tables represents % by weight) was diluted by a solvent (toluene/methylethylketone (MEK)=1/1) so that the solid components accounted for 20% to prepare an ink for a release layer. The resulting ink was applied onto a PET film having a thickness of 4.5 μm by using a wire bar coater (#3) with an amount of coat of 1.0 g/m$^2$ (when dried, the same is true hereinbelow). The resulting coat film was dried in an oven at 110° C. for one minute.

Second Layer (Peeling Layer)

The corresponding mixed matter shown in Tables 1 and 2 was diluted by a solvent (water/isopropyl alcohol) (IPA)=1/1) so that the solid components accounted for 5% to prepare an ink for a peeling layer. The resulting ink was applied to the PET film coated with the first layer by using a wire bar coater (#3) with an amount of coat of 0.2 g/m$^2$. The resulting coat film was dried in an oven at 110° C. for one minute.

Third Layer (Porous Layer)

The corresponding mixed matter shown in Tables 1 and 2 was diluted by a solvent (water/IPA=1/1) so that the solid components accounted for 15% to prepare an ink for a porous layer. The resulting ink was applied to the PET film coated with the second layer by using a wire bar coater (#3) with an amount of coat of 0.8 g/m$^2$. The resulting coat film was dried in an oven at 110° C. for one minute.

Fourth Layer (Primer Layer)

The corresponding mixed matter shown in Tables 1 and 2 was diluted by a solvent (MEK/IPA=5/1) so that the solid components accounted for 10% to prepare an ink for a primer layer. The resulting ink was applied to the PET film coated with the third layer by using a wire bar coater (#3) with an amount of coat of 0.4 g/m$^2$. The resulting coat film was dried in an oven at 110° C. for one minute.

Fifth Layer (Heat Seal (HS) Layer)

The corresponding mixed matter shown in Tables 1 and 2 was diluted by a solvent (toluene/MEK=1/1) so that the solid components accounted for 20% to prepare an ink for a heat seal layer. The resulting ink was applied to the PET film coated with the fourth layer by using a wire bar coater (#4) with an amount of coat of 1.3 g/m$^2$. The resulting coat film was dried in an oven at 110° C. for one minute.

TABLE 1

| | First layer (Release layer) | Second layer (Peeling layer) | Third layer (Porous layer) | Fourth layer (Primer layer) | Fifth layer (HS layer |
|---|---|---|---|---|---|
| Example 1 | Celltop226 (silicone-modified acrylic): 93% CelltopCAT-A (curing agent): 3.5% KF-355A(silicone oil): 3% | RS-1717(PVA): 25% PVP-K90: 25% Snowtex20L (colloidal silica): 50% | RS-1717(PVA): 20% SnowtexOL-40 (colloidal silica): 76% Sumirez resin5004 (curing agent): 4% | GantrezAN-119 (polymaleic anhydride): 50% DianalBR-87(PMMA): 42% SanprenelB-114B (urethane polyol): 8% | Byron700(polyester): 72% PUVA-50M-40TM (UVA-containing acrylic resin): 18% Tinuvin900 (UVAcompound): 8% Sylysia310P(silica filler average particle size3 μm): 2% |
| Comparative Example 1 | none | C318(PVA): 25% SnowtexOL-40 (colloidal silica): 70% VylonalMD-1500 (polyester): 4% Sumirez resin5004 (curing agent): 1% | C318(PVA): 7% SnowtexOL-40 (colloidal silica): 92% Sumirez resin5004 (curing agent): 1% | PVP-K90: 43% DianalLR-209 (acrylic polyol): 49% SanprenelB-114B (urethane polyol): 8% | same as above |
| Comparative Example 2 | Celltop226(silicone-modified acrylic): 93% CelltopCAT-A (curing agent): 3.5% KF-355A(silicone oil): 3% | same as above | same as above | same as above | same as above |
| Comparative Example 3 | same as above | RS-1717(PVA): 50% Snowtex20L (colloidal silica): 50% | RS-1717(PVA): 19% SnowtexOL-40 (colloidal silica): 76% Sumirez resin5004 (curing agent): 4% | GantrezAN-119 (polymaleic anhydride): 50% DianalBR-87(PMMA): 42% SanprenelB-114B (urethane polyol): 8% | same as above |
| Example 2 | same as above | C318(PVA): 25% PVP-K90: 25% | RS-1717(PVA): 19% SnowtexOL-40 | same as above | same as above |

TABLE 1-continued

| | First layer (Release layer) | Second layer (Peeling layer) | Third layer (Porous layer) | Fourth layer (Primer layer) | Fifth layer (HS layer |
|---|---|---|---|---|---|
| | | Snowtex20L (colloidal silica): 50% | (colloidal silica): 76% Sumirez resin5004 (curing agent): 4% | | |
| Comparative Example 4 | same as above | PVP-K90: 50% Snowtex20L (colloidal silica): 50% | same as above | same as above | same as above |
| Comparative Example 5 | same as above | RS-1717(PVA): 50% PVP-K90: 50% | same as above | same as above | same as above |

*In the table, "%" refers to "% by weight".

TABLE 2

| | First layer (Release layer) | Second layer (Peeling layer) | Third layer (Porous layer) | Fourth layer (Primer layer) | Fifth layer (HS layer) |
|---|---|---|---|---|---|
| Example 3 | Celltop226 (silicone-modified acrylic): 93% CelltopCAT-A (curing agent): 3.5% KF-355A (silicone oil): 3% | RS-1717(PVA): 25% PVP-K90: 25% Snowtex20L (colloidal silica): 50% | C318(PVA): 19% SnowtexOL-40 (colloidal silica): 76% Sumirez resin5004 (curing agent): 4% | GantrezAN-119 (polymaleic anhydride): 50% DianalBR-87(PMMA): 42% SanprenelB-114B (urethane polyol): 8% | Byron700(polyester): 72% PUVA-50M-40TM (UVA-CONTAINIG ACRYLIC RESIN): 18% Tinuvin900(UVAcompound): 8% Sylysia310P(silica filler average particle size3 μm): 2% |
| Comparative Example 6 | same as above | same as above | RS-1717(PVA): 19% SnowtexOL-40 (colloidal silica): 76% | same as above | same as above |
| Comparative Example 7 | same as above | same as above | C318(PVA): 19% Sumirez resin5004 (curing agent): 4% | same as above | same as above |
| Comparative Example 8 | same as above | same as above | same as above | PVP-K90: 50% DianalBR-87(PMMA): 42% SanprenelB-114B (urethane polyol): 8% | same as above |
| Comparative Example 9 | same as above | same as above | same as above | GantrezAN-119 (polymaleic anhydride): 50% DianalLR-209 (acrylic polyol): 42% SanprenelB-114B (urethane polyol): 8% | same as above |

*In the table, "%" refers to "% by weight".

(Preparation of Printed Article)

By using a thermal transfer film on which color material layers of yellow, magenta and cyan were formed, an image was formed by a printer (printer DPP-SV55 for photographs, made by Sony Corporation).

Then, each of protective layer thermal transfer films manufactured in the above-mentioned Examples and Comparative Examples was superposed on the image-formed portion, and the protective layer was transferred from the protective layer thermal transfer film in a manner so as to cover the image-formed portion by using the printer (printer DPP-SV55 for photographs, made by Sony Corporation) to form a printed article coated with the protective layer.

(Evaluation)

(Stamping Property)

A stamp pattern was formed on the surface of the printed article obtained as described above by using a water based stamp ink. One minute later, this was rubbed by using a paper wiper with a load of 100 g ten times, and the resulting stamp was visually evaluated on the fixing property of the stamp, and ranked in the following manner. The results are collectively shown in Table 2.

◎: The stamped character (pattern) could be clearly recognized;

○: The stamped character (pattern) could be recognized;

Δ: The stamped character (pattern) could barely be recognized; and x: The stamped character (pattern) could no longer be recognized.

(Water Resistant Property, Ethanol Resistant Property, and Acetone Resistant Property)

The surface of the printed article was rubbed by a swab moistened with water, ethanol or acetone with a load of 100 g reciprocally ten times, and the resulting image was visually observed for any damage, and ranked in the following manner. The results are collectively shown in Table 2.

◎: No degradation was observed;

○: Hardly any degradation was observed although rubbing marks were observed;

Δ: No damages to the image were observed;

x: Damages to the image were observed.

Foil-Separating Property

An image was printed on an exclusively-used image-receiving sheet by a sublimation-type printer (UP-DX100), and it was confirmed whether or not an unprinted portion in the tail portion of the printed protective layer was adhered to the image-receiving sheet (presence or absence of tailing). In the case when no tailing was observed, this was rated as "○" and in the case when tailing was observed, this was rated as"x". The results were collectively shown in Table 2.

TABLE 3

| | Stamping property | Water resistant property | Ethanol resistant property | Acetone resistant property | Foil-separating property |
|---|---|---|---|---|---|
| Example 1 | ◎ | ◎ | ◎ | ◎ | ○ |
| Comparative Example 1 | Δ | ○ | Δ | ○ | ○ |
| Comparative Example 2 | X | Δ | Δ | Δ | ○ |
| Comparative Example 3 | X | ◎ | ◎ | ◎ | ○ |
| Example 2 | ◎ | Δ | ○ | ○ | ○ |
| Comparative Example 4 | ◎ | X | X | X | ○ |
| Comparative Example 5 | ○ | X | X | X | ○ |
| Example 3 | ◎ | Δ | ◎ | ○ | ○ |
| Comparative Example 6 | ◎ | X | X | X | ○ |
| Comparative Example 7 | ◎ | ◎ | ◎ | ◎ | X |
| Comparative Example 8 | ◎ | X | ◎ | ◎ | ○ |
| Comparative Example 9 | ◎ | ◎ | ◎ | X | ○ |

The invention claimed is:

1. A protective layer thermal transfer film, comprising:

a thermally transferable protective layer on or over at least one part of one surface of a substrate film, wherein the protective layer is formed on or over the substrate by laminating at least a peeling layer serving as an outermost surface layer after transfer; and wherein a release layer is formed on the peeling layer on the substrate film side, and the peeling layer is formed from at least polyvinyl alcohol, polyvinyl pyrrolidone and an inorganic filler; and the release layer being formed from at least a silicone-modified acrylic resin, silicone oil and a curing agent.

2. The protective layer thermal transfer film of claim 1, wherein a porous layer is further formed on the peeling layer on the opposite side to the substrate, the porous layer being formed from polyvinyl alcohol, an inorganic filler and a curing agent.

3. The protective layer thermal transfer film of claim 2, wherein a primer layer is further formed on the porous layer, the primer layer being formed from at least a polymaleic anhydride resin, an acrylic resin and urethane polyol.

4. The protective layer thermal transfer film of claim 3, wherein a heat seal layer is further formed on the primer layer.

5. The protective layer thermal transfer film of claim 1, wherein a heat sublimable color material layer and/or a heat meltable color material layer are formed on one face of the substrate film together with the thermally transferable protective layer.

6. A printed article which is obtained by thermally transferring the protective layer of the protective layer thermal transfer film of claim 1 onto an image on the printed article.

7. The printed article of claim 6, wherein the image on the printed article is formed by an electro-photographic system, an ink jet recording system or a thermal transfer recording system.

8. The printed article of claim 6, wherein the image on the printed article is formed by the thermal transfer recording system.

* * * * *